US007931779B2

(12) United States Patent
Fredriksson

(10) Patent No.: US 7,931,779 B2
(45) **Date of Patent: *Apr. 26, 2011**

(54) SCREENING APPARATUS AND SCREEN BASKET FOR SCREENING PULP SUSPENSIONS

(75) Inventor: Börje Fredriksson, Karlstad (SE); Linus Fredriksson, legal representative, Stockholm (SE)

(73) Assignee: Metso Paper, Inc. (FI)

( * ) Notice: Subject to any disclaimer, the term of this patent is extended or adjusted under 35 U.S.C. 154(b) by 1069 days.

This patent is subject to a terminal disclaimer.

(21) Appl. No.: 10/578,207

(22) PCT Filed: Sep. 21, 2004

(86) PCT No.: PCT/SE2004/001352

§ 371 (c)(1),
(2), (4) Date: Mar. 22, 2007

(87) PCT Pub. No.: WO2005/045128

PCT Pub. Date: May 19, 2005

(65) Prior Publication Data

US 2007/0246181 A1 Oct. 25, 2007

(30) Foreign Application Priority Data

Nov. 6, 2003 (SE) ..... 0302932

(51) Int. Cl.
*D21C 7/06* (2006.01)

(52) U.S. Cl. ..... 162/246; 162/251; 162/380; 210/411

(58) Field of Classification Search ..... 162/246, 162/251, 55, 380; 209/305; 210/411, 415
See application file for complete search history.

(56) References Cited

U.S. PATENT DOCUMENTS 4,717,471 A 1/1988 Winkler
4,986,900 A 1/1991 Mason
6,241,102 B1 6/2001 Lindberg et al.

(Continued)

FOREIGN PATENT DOCUMENTS

DE 39 40 334 A1 6/1991

(Continued)

OTHER PUBLICATIONS

Forbes, David R., "Pulp Mill Screening is Key to Pulp Quality, Maximum Fiber Utilization," Pulp & Paper, Nov. 1987, pp. 107-112.

(Continued)

*Primary Examiner* — Mark Halpern
(74) *Attorney, Agent, or Firm* — Lerner, David, Littenberg, Krumholz & Mentlik, LLP

(57) ABSTRACT

A screen for the screening of pulp suspensions is disclosed, including a screen basket, a rotor for providing pressure and suction pulses in the suspension to be screened along the screen basket, and a dilution liquid header for supplying dilution liquid to counteract thickening of the suspension during operation. The header forms a tubular channel, which divides the screen basket into at least two parts, extends around the basket, and is provided with a plurality of dilution ejection nozzles. Each ejection nozzle forms a channel including at least two channel sections; namely, an entrance channel section that opens into the channel of the header, and an exit channel section downstream of the entrance channel section, wherein the entrance channel section is substantially wider than the exit channel section.

22 Claims, 5 Drawing Sheets

U.S. PATENT DOCUMENTS

| | | | | |
|---|---|---|---|---|
| 6,290,067 | B1 * | 9/2001 | Bergdahl et al. | 209/273 |
| 6,571,957 | B1 * | 6/2003 | Doelle et al. | 209/273 |
| 6,585,116 | B1 * | 7/2003 | Doelle et al. | 209/305 |
| 6,679,384 | B1 * | 1/2004 | Serres et al. | 209/273 |

FOREIGN PATENT DOCUMENTS

| | | | |
|---|---|---|---|
| DE | 41 21 896 | A1 | 1/1993 |
| EP | 0 905 309 | B1 | 11/2001 |
| EP | 0 958 431 | B1 | 1/2002 |
| FR | 2 613 390 | A1 | 10/1988 |
| SE | 506 602 | C2 | 1/1998 |
| SE | 510 967 | C2 | 7/1999 |
| SE | 513 793 | C2 | 6/2000 |
| SE | 524 527 | C2 | 8/2004 |
| WO | WO-93/04797 | A1 | 3/1993 |
| WO | WO-93/07334 | A1 | 4/1993 |
| WO | WO-99/28549 | A1 | 6/1999 |
| WO | WO-00/50690 | A1 | 8/2000 |
| WO | WO-03/104549 | A1 | 12/2003 |

OTHER PUBLICATIONS

Gullichsen, J. & Paulapuro, H., eds., Papermaking Science and Technology, Chemical Pulping, Book 6A, Fapet Oy, Helsinki, Finland 1999, pp. A608-09.

Smook, Gary A., Handbook for Pulp & Paper Technologists, Angus Wilde Publications, Vancouver, B.C., 2002, pp. 110-112.

Boettcher, Peter C., "Results From a New Design of Contoured Screen Plate," 1986 Pulping Conference, pp. 279-283.

* cited by examiner

SCREENING APPARATUS AND SCREEN BASKET FOR SCREENING PULP SUSPENSIONS

This application is a 371 of PCT/SE04/01352 filed 21 Sep. 2004.

FIELD OF THE INVENTION

The present invention relates to a screening apparatus for screening pulp suspensions, comprising a housing, a tubular screen basket dividing the interior of the housing into a central chamber and an outer substantially annular chamber, an inlet member for supplying a suspension to be screened into either the central chamber or the outer chamber, an accept outlet member for discharging a developed accept fraction of the suspension that has passed through the screen basket, and a reject outlet member for discharging a developed reject fraction of the suspension. The present invention also relates to a rotor arranged in the housing for providing pressure and suction pulses in the suspension to be screened along the screen basket. The apparatus of the present invention further relates to a dilution liquid header in the housing for supplying dilution liquid to counteract thickening of the suspension during operation. The header forms a tubular channel dividing the basket into at least two parts and extending at least substantially around the screen basket. At least one dilution liquid supply conduit is provided for supplying dilution liquid from outside the housing to the channel of the header. The header further is provided with a plurality of ejection nozzles for ejecting dilution liquid from the tubular channel.

The present invention also relates to a screen basket suited for use in the above-described screening apparatus.

BACKGROUND OF THE INVENTION

Apparatus of the type described above in the form a multi-stage screening apparatus is disclosed in Swedish Patent No. 524,527. The tubular channel of the dilution liquid header of this multi-stage apparatus has a constant cross-sectional area and the ejection nozzles of the header are identical.

A problem with this design of the prior header according to Swedish Patent No. 524,527 is that the dilution liquid flow rates in the respective ejection nozzles can vary considerably, so that the flow rates in the ejection nozzles located more downstream along the tubular channel are higher than the flow rates in the nozzles located more upstream. The varying flow rates in the different ejection nozzles result in a disadvantageous uneven distribution of the dilution liquid to the suspension.

One potential solution to this problem would be to provide uniform flow rates in the ejection nozzles of the prior header with constant cross-sectional area of the tubular channel and this could be done by designing all ejection nozzles with different sizes, so that the more upstream nozzles are wider, whereas the more downstream nozzles are narrower. A disadvantage to this solution, however, is that in practice it is very difficult to properly size the different ejection nozzles, especially when there is a great number of ejection nozzles. Besides, even if a series of ejection nozzle sizes has been correctly calculated this series is only valid for a given main dilution liquid stream supplied to the tubular channel of the header. In consequence, the distribution of dilution liquid through the ejection nozzles would not be uniform for other main liquid streams that exceed or are less than said given main liquid stream.

Another potential solution to the above problem is by providing uniform flow rates in the ejection nozzles of the prior header could be to design the tubular channel tapering in the direction of the dilution liquid stream, so that the static pressures in the dilution liquid at the entrances of the ejection nozzles are equal, which would result in equal flow rates in the ejection nozzles. However, it is complicated to design such a header, because to achieve the desired equal static pressure states at the different ejection nozzles the degree of taper of the tubular channel must be varied along the channel. In addition, the correct taper of the channel is dependent on the friction between the dilution liquid and the wall surface of the tubular channel.

One of the objects of the present invention is to improve the screening apparatus according to Swedish Patent No. 524, 527, so that the header uniformly distributes dilution liquid to the suspension to be screened.

Another object of the present invention is to provide a screen basket for use in the improved screening apparatus of the present invention, and also for replacing screen baskets in existing screening apparatuses commercially operated.

SUMMARY OF THE INVENTION

In accordance with the present invention, these and other objects are realized by a screening apparatus of the type described above initially characterized in that each ejection nozzle includes at least two channel sections, an entrance channel section that opens into the channel of the header and an exit channel section downstream of the entrance channel section, the entrance channel section being substantially wider than the exit channel section. As a result, the wider entrance channel section forms a volume in which the velocity of the main stream in the channel is substantially decreased, so that when part streams of the main stream are diverged into the entrance channel sections, dynamic pressure of the main stream is converted into substantially equal static pressures in the entrance channel sections. These static pressures feed the narrow exit channel sections with liquid streams of substantially equal flow rates.

The entrance channel section of each ejection nozzle may have a volume large enough to house an eddy current created in the stream of dilution liquid diverging from the tubular channel into the entrance section of the ejection nozzle, when dilution liquid is supplied by the header. As a result, an eddy current is prevented from being created in the exit channel section, which is beneficial with respect to reducing the impact of existing fluctuating counter pressure at the discharge side of the ejection nozzles. If an eddy current were created in the exit channel section it would be much easier for a counter pressure to move material from the discharge side of the injection nozzles back into the channel of the header. As an alternative, the entrance channel section of each ejection nozzle may have a volume large enough to prevent the creation of an eddy current in the stream of dilution liquid in the exit channel section, when dilution liquid is supplied by the header, i.e. without the aid of creating an eddy current in the entrance channel section.

According to one embodiment of the present invention, the volume of the entrance channel section should be from 0.2 to 2 times the volume of the exit channel section.

In accordance with another embodiment of the invention, the entrance channel section of each ejection nozzle has a width that is 25 to 100% wider than that of the exit channel section and the length of the entrance channel section of each ejection nozzle is 5 to 50% of the width of the entrance channel section.

In accordance with yet another embodiment of the present invention, the ejection nozzles are identical and the tubular channel of the header has a constant cross-sectional area along its length. Each ejection nozzle channel may have an elongated or circular cross-section.

In accordance with the present invention, other objects of the present invention are realized by a screen basket for screening pulp suspensions, comprising a tubular mantle wall provided with screen apertures, and a dilution liquid header on the mantle wall forming a tubular channel for dilution liquid extending at least substantially around the mantle wall, the header being provided with a plurality of ejection nozzles, The screen basket is characterised in that each ejection nozzle forms a channel including at least two channel sections, an entrance channel section that opens into the channel of the header and an exit channel section downstream of the entrance channel section, the entrance channel section being substantially wider than the exit channel section.

The screen basket of the present invention may be designed similar to the screen basket of the above-described screening apparatus of the present invention.

BRIEF DESCRIPTION OF THE DRAWINGS

The present invention will be more fully appreciated with reference to the following detailed description, in which reference is made to the accompanying drawings, in which.

DETAILED DESCRIPTION

Figure 1:
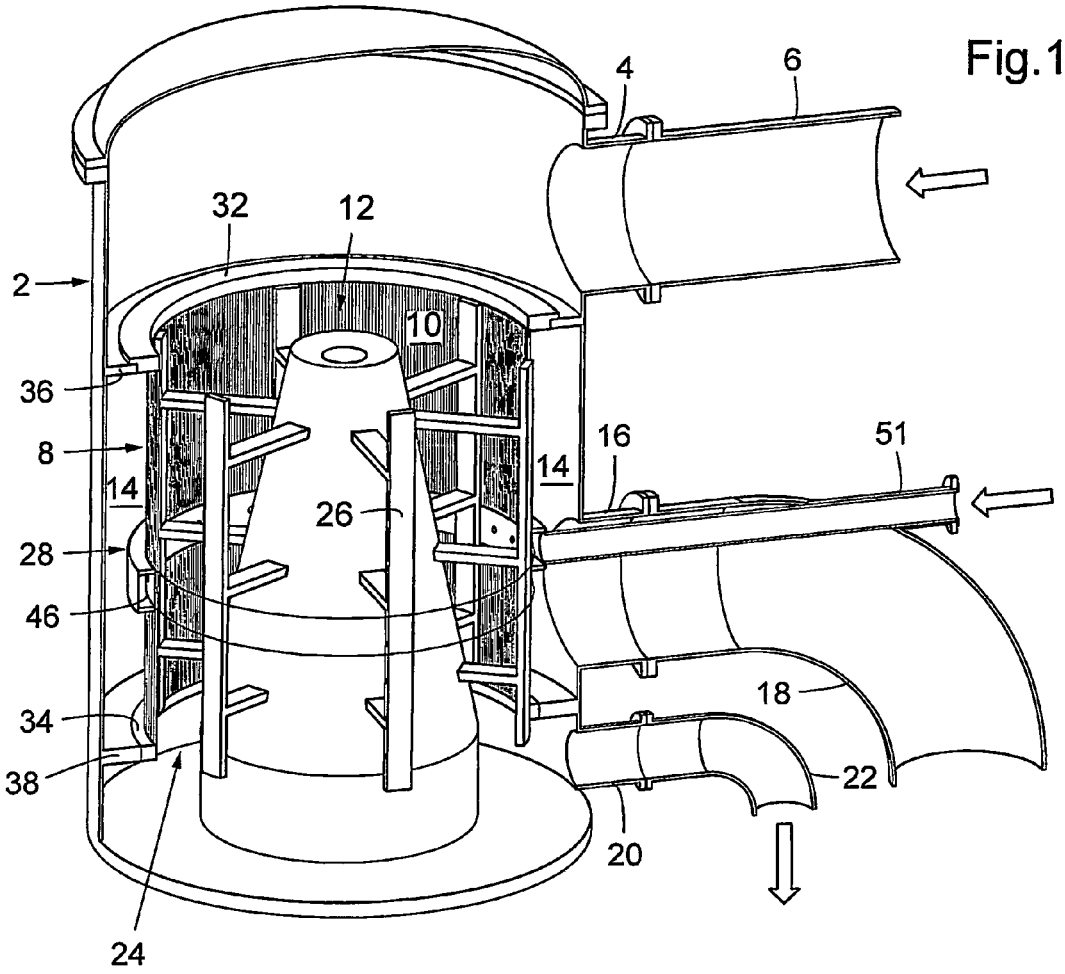
FIG. 1 is a side, partially cut away, perspective view of a first embodiment of the screening apparatus of the present invention.

Referring to the drawings, identical or corresponding elements shown in the figures are denoted with the same reference numerals.

FIG. 1 shows a screening apparatus according to the present invention for screening pulp suspensions, comprising a housing 2, an inlet member 4 releasably connected to a supply pipe 6 for supplying a suspension to be screened into the housing 2, a tubular screen basket 8 dividing the interior of the housing 2 into a central substantially cylindrical chamber 10 for receiving the suspension to be screened at one end 12 of the central chamber and a single outer annular accept chamber 14 for receiving an accept fraction of the suspension that has passed through the screen basket 8, an accept outlet member 16 releasably connected to an accept outlet pipe 18 for discharging the accept fraction from the accept chamber 14 and a reject outlet member 20 releasably connected to a reject outlet pipe 22 for discharging a reject fraction of the suspension from the central chamber 10 at the other end 24 thereof. A rotor 26 is arranged in the central chamber 10 for providing pressure and suction pulses in the suspension along the screen basket 8. A dilution liquid annular header 28 is provided for supplying dilution liquid to the central chamber 10 between the ends 12 and 24 thereof.

Figure 3:
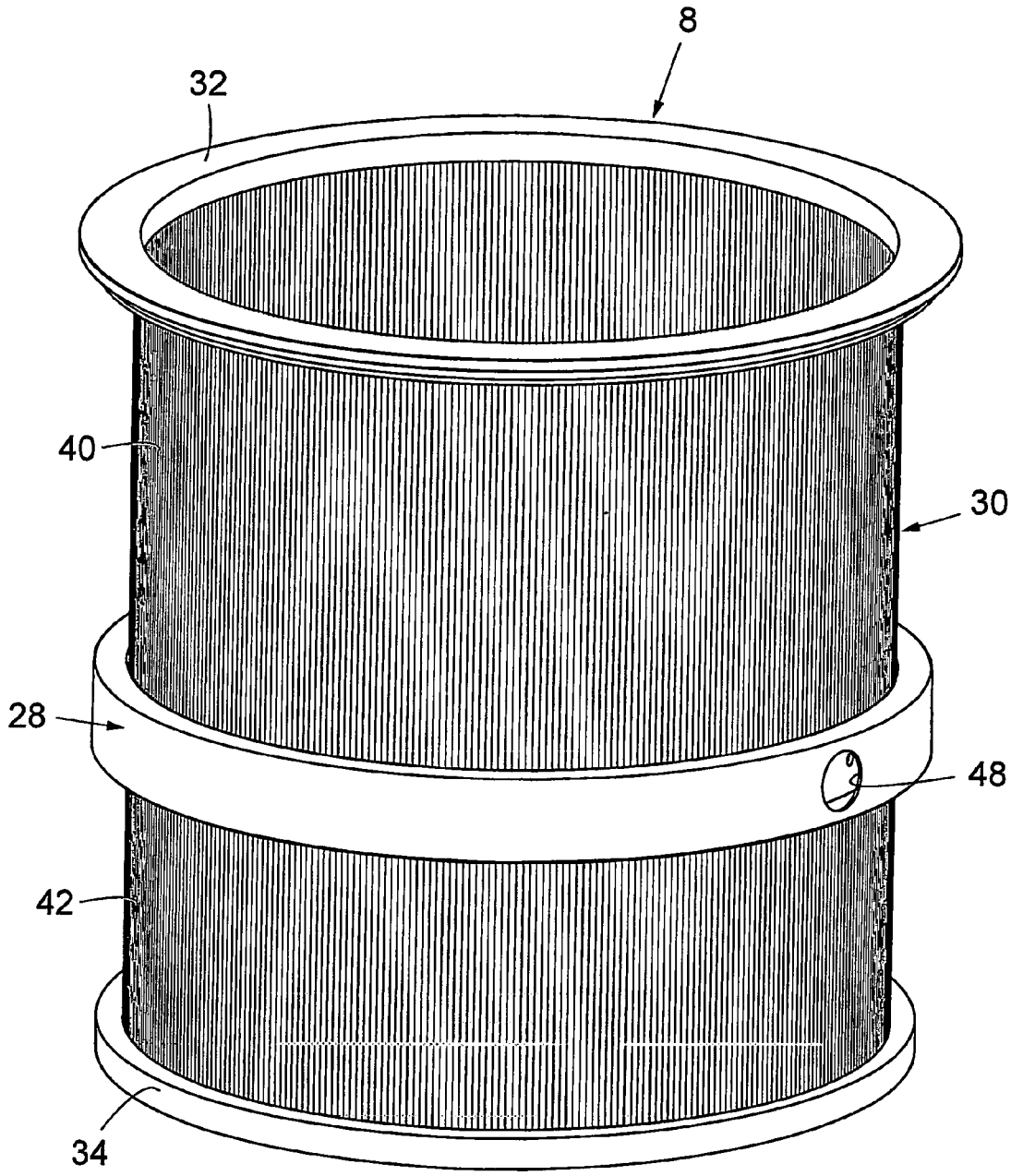
FIG. 3 is a side, perspective view of a screen basket for use in the apparatus shown in FIG. 1.
Figure 4:
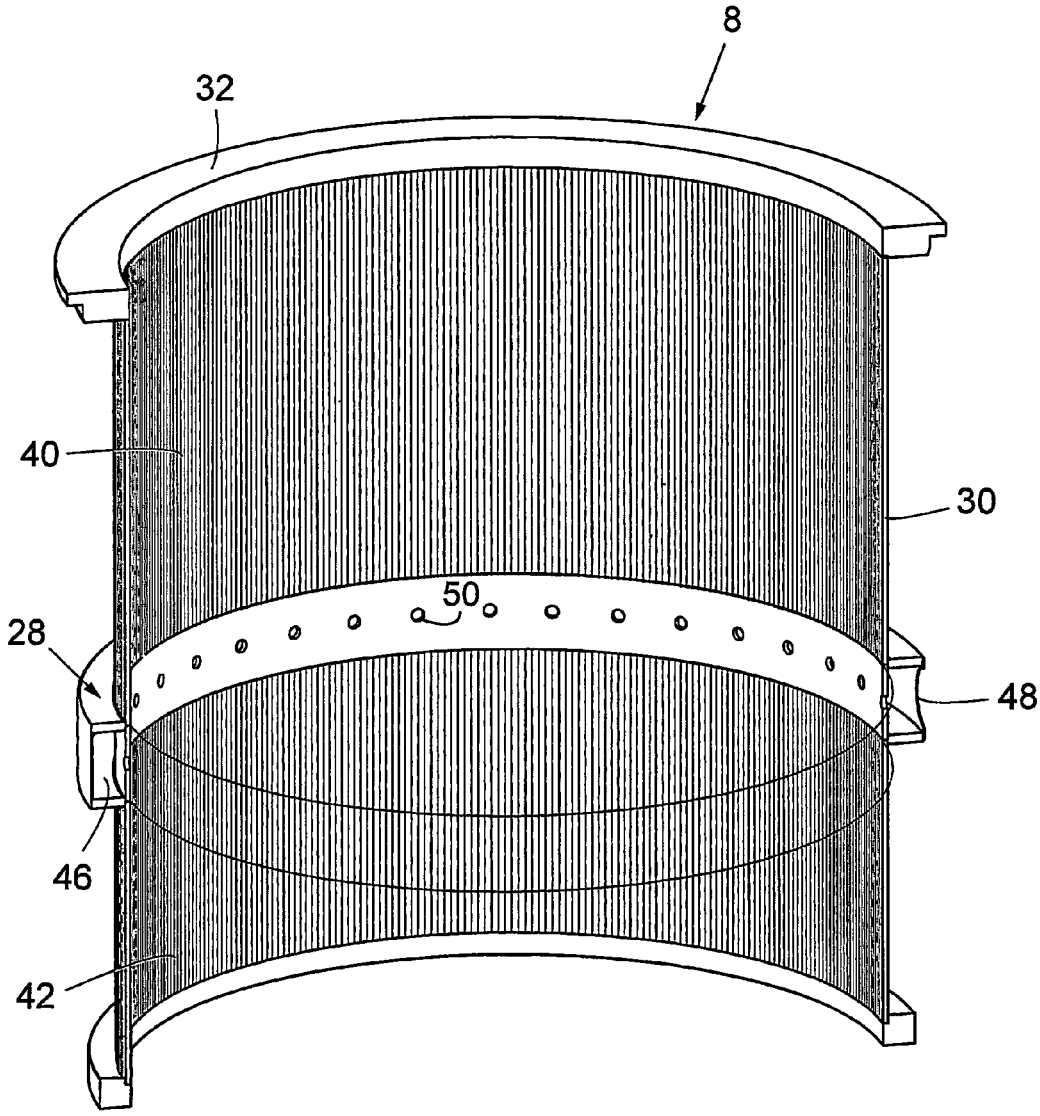
FIG. 4 is a side, partially sectional, perspective view of the screen basket shown in FIG. 3.

With reference to FIGS. 3 and 4, the screen basket 8 comprises a cylindrical mantle wall 30 with screen apertures taking the shape of slots. The mantle wall 30 is provided with an upper flange 32 and a lower flange 34 that seal against an upper shoulder 36 on the housing and a lower shoulder 38 on the housing, respectively. The mantle wall 30 is divided into two separate cylindrical parts 40 and 42, which are axially interconnected by the annular header 28. The header 28 forms a tubular dilution liquid channel 46 having a rectangular cross-section and extending around the mantle wall 30. The header 28 is provided with a dilution liquid inlet opening 48 and a multiplicity of ejection nozzles 50 for ejecting dilution liquid from channel 46 to the inside of the screen basket 8. A dilution liquid supply conduit 51 for supplying dilution liquid from outside the housing 2 to the dilution liquid channel 46 extends through the wall of the accept outlet pipe 18 and is connected to the inlet opening 48 of the header 28 (Alternatively, two or more dilution liquid inlet openings, preferably two openings, may be provided.)

Figure 5:
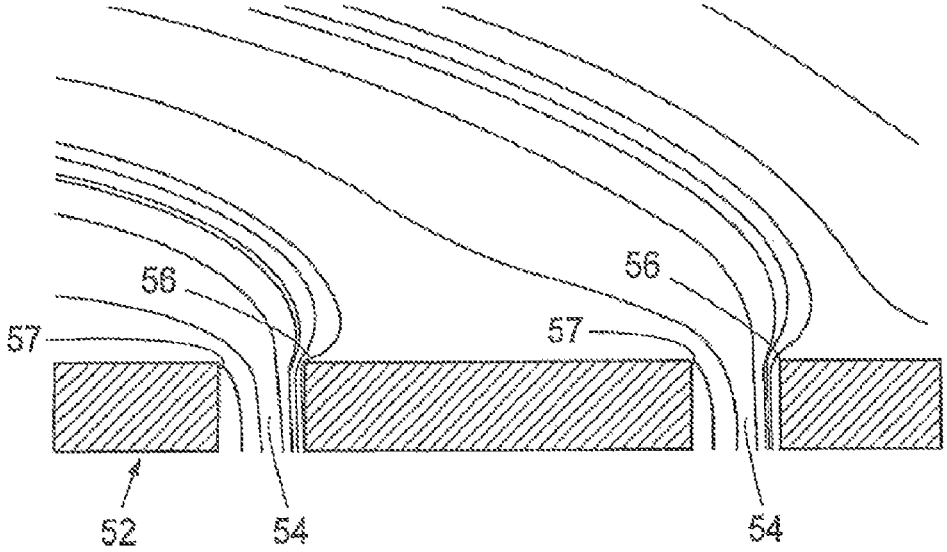
Fig. 5 (PRIOR ART)
FIG. 5 is a side, partial, enlarged, sectional illustrative view of the dilution liquid flow pattern through ejection nozzles forming traditional cylindrical channels.

FIG. 5 illustrates typical dilution liquid flow paths in a header 52 with ejection nozzles forming conventional cylindrical channels 54. In the header 52 of FIG. 5 the dilution liquid flows from left to right. As is clear from FIG. 5, the-part streams of dilution liquid that are diverged from the main stream of dilution liquid into the cylindrical channels 54 of the ejection nozzles are disturbed by the distant entrance edges 56 of the ejection nozzles (as seen in the flow direction of the main dilution liquid stream in the header 52). These disturbances in the part streams give rise to more or less uneven flow profiles across the channels 54, so that part streams of different flow rates will occur in the respective channels 54. Furthermore, lower pressure zones occur in the part streams at the proximate entrance edges 57 of the ejection nozzles (as seen in the flow direction of the main dilution liquid stream in the header 52). These lower pressure zones may give rise to the drawback that momentary counter pressures created by the rotor 26 sweeping along the mantle wall 30 may cause fibres to enter the nozzle channels 54 at the proximate entrance edges and accumulate in the header channel 46.

Figure 6:
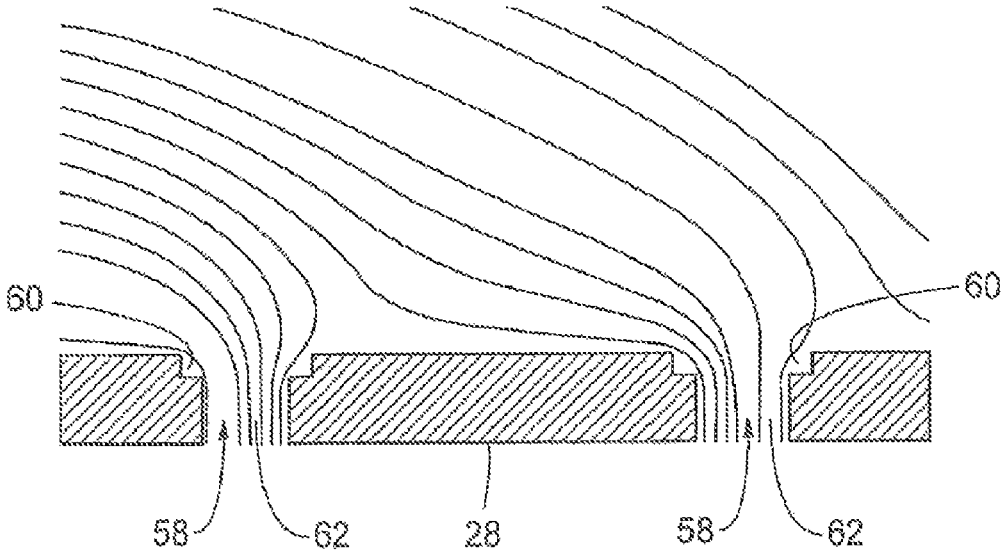
FIG. 6 is a side, partial, enlarged, sectional, illustrative view of the dilution liquid flow pattern through ejection nozzles designed in accordance with the present invention.

FIG. 6 illustrates the dilution liquid flow paths in the header 28 of the apparatus according to the present invention. Each ejection nozzle 50 forms a cylindrical channel 58 that includes two different cylindrical channel sections, an entrance channel 60 that opens into the channel 46 of the header 28 and an exit channel section 62 downstream of the entrance channel section 60. The entrance channel section 60 is wider than the exit channel section 62 and forms a volume in which the velocity of the main stream in the channel 46 is substantially decreased, so that when part streams of the main stream are diverged into the respective entrance channel sections 60 the dynamic pressure of the main stream is converted into substantially equal static pressures in the entrance channel sections 60. These static pressures feed the respective narrower exit channel sections 62 with part streams of substantially equal flow rates. As a result, the pressure and flow distribution of the part streams in the nozzle channels 58 are homogenous, which make the flow through the channels 58 less sensitive to momentary counter pressures created by the rotating rotor.

Each exit channel section 62 may have a circular cross-section with a diameter in the range of from 2 to 20 mm, preferably from 5 to 15 mm. Alternatively, each exit channel section 62 may take the shape of a slot with a width in the range of from 2 to 20 mm, and preferably from 5 to 15 mm.

The screen basket 8 described above is particularly suited for replacing traditional single stage screen baskets in old screening apparatuses. By utilizing the existing accept outlet member to connect the dilution liquid supply conduit there is no need for reconstructing the housing of the old apparatus.

In operation, a fiber suspension to be screened is fed via the inlet member 4 to the screen basket 8 at the upper side 12 thereof. In the screen basket 8 the suspension is screened along section 40 of the mantle wall 30, so that a primary accept fraction passes through the screen apertures of the mantle wall 30 while a primary reject fraction develops inside the screen basket 8. The primary reject fraction is diluted by a controlled flow of dilution liquid sprayed through the ejection nozzles 50. The diluted primary reject fraction is screened along section 42 of the mantle wall 30, so that a secondary accept fraction passes through the mantle wall 30 while a secondary reject fraction develops inside the screen basket 8 and then is discharged from the screen basket 8 through the reject outlet member 20. The primary and secondary accept fractions are combined and discharged through the accept outlet member 16.

The flow of dilution liquid through the ejection nozzles 50 is controlled in response to the consistency and flow of the suspension being fed to the screen basket 8 and the consistency and flow of the secondary reject fraction being discharged from the screen basket 8, so that the consistency of the primary reject fraction entering section 42 of the mantle wall 30 becomes substantially the same as the consistency of the suspension being fed into the screen basket 8.

Figure 2:
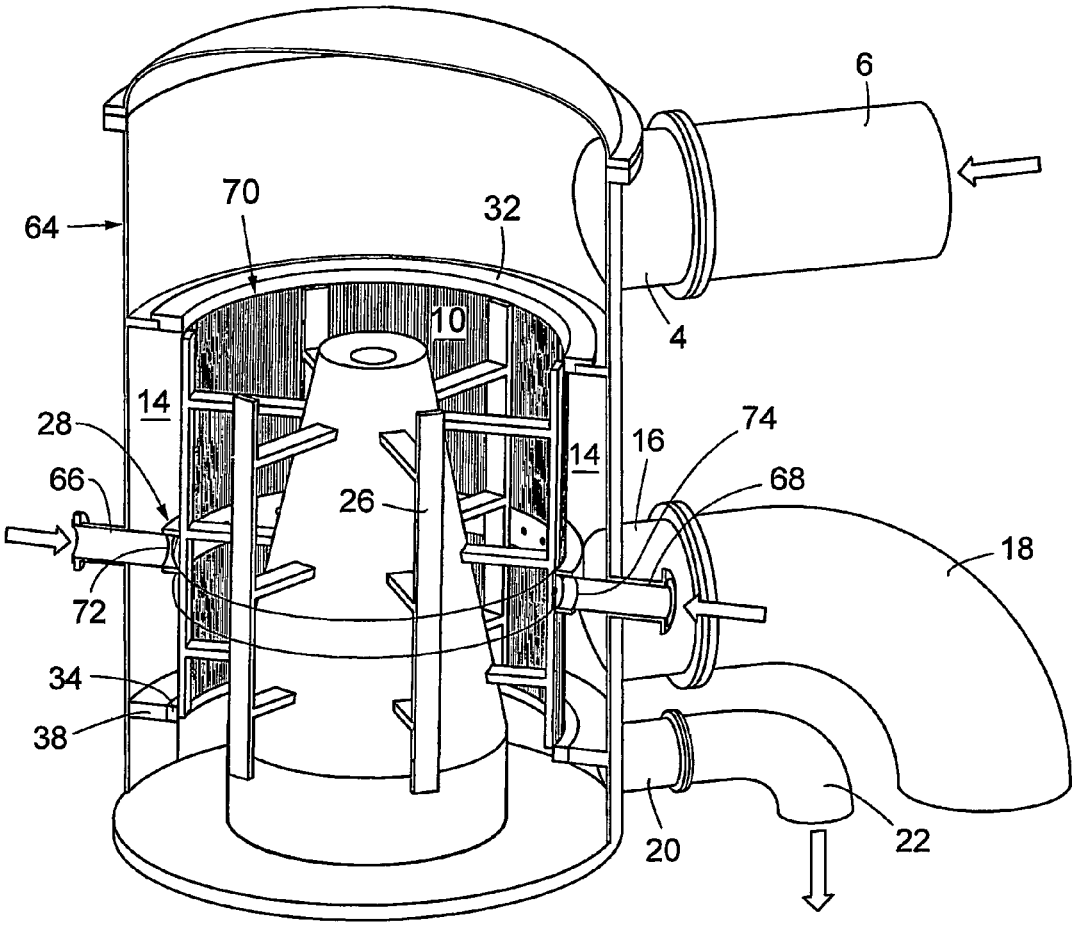
FIG. 2 is a side, partially cut away, perspective view of a second embodiment of the screening apparatus of the present invention.

FIG. 2 shows a screening apparatus of the invention similar to the embodiment shown in FIG. 1 except that the screen basket and the dilution liquid supply are designed differently. Thus, the apparatus of FIG. 2 comprises a housing 64 provided with two dilution liquid inlet conduits 66 and 68, and a screen basket 70 provided with two dilution liquid inlet openings 72 and 74 connected to the conduits 66 and 68, respectively. This embodiment is suited for new screening apparatuses.

As an alternative to the embodiments of FIGS. 1 and 2 described above, the present invention may also be implemented in the type of screening apparatuses in which the rotor is arranged in the outer annular chamber and the suspension is fed from the outer annular chamber through the screen basket into the central chamber.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A screening apparatus for screening pulp suspensions, comprising a housing (2;64), a tubular screen basket (8;70) dividing the interior of the housing into a central chamber (10) and an outer substantially annular chamber (14), an inlet member (4) for supplying a suspension to be screened into either the central chamber or the outer chamber, an accept outlet member (16) for discharging a developed accept fraction of the suspension that has passed through the screen basket, a reject outlet member (20) for discharging a developed reject fraction of the suspension, a rotor (26) arranged in the housing for providing pressure and suction pulses in the suspension to be screened along the screen basket, a dilution liquid header (28) in the housing for supplying dilution liquid to counteract thickening of the suspension during operation, the header forming a tubular channel (46) dividing the basket into at least two parts (40,42) and extending at least substantially around the screen basket, and at least one dilution liquid supply conduit (51;66,68) for supplying dilution liquid from outside the housing to the channel of the header, the header being provided with a plurality of ejection nozzles (50) for ejecting dilution liquid from the tubular channel, characterized in that each ejection nozzle forms a channel (58) including at least two channel sections, an entrance channel section (60) that opens into the channel (46) of the header and an exit channel section (62) downstream of the entrance channel section, the entrance channel section being substantially wider than the exit channel section.

2. A screening apparatus according to claim 1, wherein the entrance channel section (60) of each ejection nozzle (50) has a volume large enough to house an eddy current created in the stream of dilution liquid diverging from the tubular channel (46) into the entrance channel section of the ejection nozzle, when dilution liquid is supplied by the header (28).

3. A screening apparatus according to claim 1 or 2, wherein the entrance channel section (60) of each ejection nozzle has a volume large enough to prevent formation of an eddy current in the stream of dilution liquid in the exit channel section (62), when dilution liquid is supplied by the header (28).

4. A screening apparatus according to claim 1, wherein the volume of the entrance channel section (60) of each ejection nozzle is 0.2 to 2 times the volume of the exit channel section (62).

5. A screening apparatus according to any one of claims 1-4, wherein the width of the entrance channel section (60) of each ejection nozzle is 25 to 100% wider than that of the exit channel section (62).

6. A screening apparatus according to claim 5, wherein the length of the entrance channel (60) section of each ejection nozzle is 5 to 50% of the width of the entrance channel section (62).

7. A screening apparatus according to any one of claims 1-6, wherein the ejection nozzles (50) are identical.

8. A screening apparatus according to any one of claims 1-7, wherein the tubular channel (46) has a constant cross-sectional area along its length.

9. A screening apparatus according to any one of claims 1-8, wherein each of said ejection channels (58) has a circular cross-section.

10. A screening apparatus according to any one of claims 1-8, wherein each ejection channel (58) has an elongated cross-section.

11. A screening apparatus according to any one of claims 1-10, wherein each ejection nozzle (50) is arranged to eject dilution liquid at least substantially perpendicular from the tubular channel (46).

12. A screen basket (8;70) for screening pulp suspensions, comprising a tubular mantle wall (30) provided with screen apertures, and a dilution liquid header (28) on the mantle wall forming a tubular channel (46) for dilution liquid extending at least substantially around the mantle wall, the header forming a plurality of ejection nozzles (50), characterized in that each ejection nozzle forms a channel (58) including at least two channel sections, an entrance channel section (60) that opens into the channel (46) of the header (28) and an exit channel section (62) downstream of the entrance channel section, the entrance channel section being substantially wider than the exit channel section.

13. A screen basket according to claim 12, wherein the entrance channel section (60) of each ejection nozzles has a volume large enough to house an eddy current created in the stream of dilution liquid diverging from the tubular channel into the entrance section of the plurality of ejection nozzles, when dilution liquid is supplied by the header.

14. A screen basket according to claim 12 or 13, wherein the entrance channel section (60) of each ejection nozzle has a volume large enough to prevent formation of an eddy current in the stream of dilution liquid in the exit channel section (62), when dilution liquid is supplied by the header.

15. A screen basket according to claim 14, wherein the volume of the entrance channel section (60) is 0.2 to 2 times the volume of the exit channel section (62).

16. A screen basket according to any one of claims 12-15, wherein the entrance channel section (60) of each ejection nozzle has a width that is 25 to 100% wider than that of the exit channel section (62).

17. A screen basket according to claim 16, wherein the length of the entrance channel section (60) of each ejection nozzle is 5 to 50% of the width of the entrance channel section.

18. A screen basket according to any one of claims 12-17, wherein the ejection nozzles (50) are identical.

19. A screen basket according to any one of claims 12-18, wherein the tubular channel (46) has a constant cross-sectional area along its length.

20. A screen basket according to any one of claims 12-19, wherein each of the ejection channel (58) has a circular cross-section.

21. A screen basket according to any one of claims 12-19, wherein each ejection channel (58) has an elongated cross-section.

22. A screen basket according to any one of claims 12-21, wherein each ejection nozzle (50) is arranged to eject dilution liquid at least substantially perpendicular from the tubular channel (46).

* * * * *

UNITED STATES PATENT AND TRADEMARK OFFICE

CERTIFICATE OF CORRECTION

PATENT NO. : 7,931,779 B2
APPLICATION NO. : 10/578207
DATED : April 26, 2011
INVENTOR(S) : Börje Fredriksson It is certified that error appears in the above-identified patent and that said Letters Patent is hereby corrected as shown below:

Column 4, line 25, "the-part" should read --the part--.
Delete column 5, line 54 through column 8, line 15, and substitute therefor the following:

1. A screening apparatus for screening pulp suspensions, comprising:

a housing, a screen basket having a first side and a second side and dividing the interior of the housing into a central chamber and an outer substantially annular chamber, an inlet member for supplying a suspension to be screened to said first or second sides of said screen basket, an accept outlet member for discharging a developed accept fraction of the suspension that has passed through the screen basket, a reject outlet member for discharging a developed reject fraction of the suspension that has not passed through the screen basket, a rotor arranged in the housing for providing pressure and suction pulses in the suspension to be screened along the screen basket, a dilution liquid header in the housing for supplying dilution liquid to counteract thickening of the suspension during operation, the header forming a tubular channel dividing the screen basket into at least two parts and extending at least substantially around the screen basket, and at least one dilution liquid supply conduit for supplying dilution liquid from outside the housing to the tubular channel of the header, the header being provided with a plurality of ejection nozzles for ejecting dilution liquid from the tubular channel, Signed and Sealed this
Eighth Day of May, 2012

David J. Kappos

David J. Kappos
*Director of the United States Patent and Trademark Office* wherein each of said plurality of ejection nozzles forms a channel including at least two channel sections, including an entrance channel section that opens into the channel of the header and an exit channel section downstream of the entrance channel section, the entrance channel section being substantially wider than the exit channel section.

2. A screening apparatus according to claim 1, wherein the entrance channel section of each of said plurality of ejection nozzles has a volume large enough to house an eddy current created in the stream of dilution liquid diverging from the tubular channel into the entrance channel section of each of said plurality of ejection nozzles, when dilution liquid is supplied by the header.

3. A screening apparatus according to claim 1, wherein the entrance channel section of each of said plurality of ejection nozzles has a volume large enough to prevent formation of an eddy current in the stream of dilution liquid in the exit channel section, when dilution liquid is supplied by the header.

4. A screening apparatus according to claim 1, wherein the volume of the entrance channel section of each of said plurality of ejection nozzles is 0.2 to 2 times the volume of the exit channel section.

5. A screening apparatus according to claim 1, wherein the width of the entrance channel section of each of said plurality of ejection nozzles is 25 to 100% wider than that of the exit channel section.

6. A screening apparatus according to claim 5, wherein the length of the entrance channel section of each of said plurality of ejection nozzles is 5 to 50% of the width of the entrance channel section.

7. A screening apparatus according to claim 1, wherein each of said plurality of ejection nozzles is identical.

8. A screening apparatus according to claim 1, wherein the tubular channel has a constant cross-sectional area along its length.

9. A screening apparatus according to claim 1, wherein each of said ejection channels has a circular cross-section.

10. A screening apparatus according to claim 1, wherein each of said ejection channels has an elongated cross-section.

11. A screening apparatus according to claim 1, wherein each of said plurality of ejection nozzles is arranged to eject dilution liquid at least substantially perpendicular from the tubular channel.

12 . A screen basket for screening pulp suspensions, comprising:

a tubular mantle wall provided with screen apertures, and a dilution liquid header on the mantle wall forming a tubular channel for dilution liquid extending at least substantially around the mantle wall, the dilution liquid header forming a plurality of ejection nozzles, wherein each of said plurality of ejection nozzles forms a channel including at least two channel sections, including an entrance channel section that opens into the channel of the header and an exit channel section downstream of the entrance channel section, the entrance channel section being substantially wider than the exit channel section.

13. A screen basket according to claim 12, wherein the entrance channel section of each of said plurality of ejection nozzles has a volume large enough to house an eddy current created in the stream of dilution liquid diverging from the tubular channel into the entrance section of the plurality of ejection nozzles, when dilution liquid is supplied by the header.

14. A screen basket according to claim 12, wherein the entrance channel section of each of said plurality of ejection nozzles has a volume large enough to prevent formation of an eddy current in the stream of dilution liquid in the exit channel section, when dilution liquid is supplied by the header.

15. A screen basket according to claim 14, wherein the volume of the entrance channel section is 0.2 to 2 times the volume of the exit channel section.

16. A screen basket according to claim 12, wherein the entrance channel section of each of the plurality of ejection nozzles has a width that is 25 to 100% wider than that of the exit channel section.

17. A screen basket according to claim 16, wherein the length of the entrance channel section of each of the plurality of ejection nozzles is 5 to 50% of the width of the entrance channel section.

18. A screen basket according to claim 12, wherein each of said plurality of ejection nozzles is identical.

19. A screen basket according to claim 12, wherein the tubular channel has a constant cross-sectional area along its length.

20. A screen basket according to claim 12, wherein each of the ejection channels has a circular cross-section.

21. A screen basket according to claim 12, wherein each of the ejection channel has an elongated cross-section.

22. A screen basket according to claim 12, wherein each of the plurality of ejection nozzles is arranged to eject dilution liquid at least substantially perpendicular from the tubular channel.